US011051604B2

(12) United States Patent
Phillips

(10) Patent No.: US 11,051,604 B2
(45) Date of Patent: Jul. 6, 2021

(54) INFANT TOOTHBRUSH

(75) Inventor: Heather Phillips, West Jordan, UT (US)

(73) Assignee: Live-Right, LLC, Sandy, UT (US)

( * ) Notice: Subject to any disclaimer, the term of this patent is extended or adjusted under 35 U.S.C. 154(b) by 0 days.

(21) Appl. No.: 12/666,262

(22) PCT Filed: Apr. 9, 2008

(86) PCT No.: PCT/US2008/059748

§ 371 (c)(1),
(2), (4) Date: Dec. 22, 2009

(87) PCT Pub. No.: WO2009/002583

PCT Pub. Date: Dec. 31, 2008

(65) Prior Publication Data

US 2010/0319149 A1 Dec. 23, 2010

Related U.S. Application Data

(60) Provisional application No. 60/946,329, filed on Jun. 26, 2007.

(51) Int. Cl.
*A46B 5/02* (2006.01)

(52) U.S. Cl.
CPC ..... *A46B 5/02* (2013.01); *A46B 5/023* (2013.01); *A46B 2200/1066* (2013.01)

(58) Field of Classification Search
CPC ..... A46B 9/04; A46B 2200/1066; A46B 9/06; A46B 5/02; A46B 5/023; A46B 2200/30; A46B 5/025; A46B 7/06; A46B 7/04
USPC ..... 15/167.1, 105, 110, 143.1, 246.22, 22.1
See application file for complete search history.

(56) References Cited

U.S. PATENT DOCUMENTS 878,486 A * 2/1908 Crowell ..... A46B 11/0093 15/167.1
2,254,365 A * 9/1941 Griffith et al. ..... 15/167.1
2,254,368 A * 9/1941 Holbrook ..... 353/79
3,120,670 A * 2/1964 Amodeo ..... A46B 15/0038 15/167.1
4,351,080 A * 9/1982 Grossman ..... A46B 5/02 15/143.1
4,654,921 A * 4/1987 Dinner ..... 15/167.1
5,048,143 A * 9/1991 Carroll ..... A46B 5/02 15/105

(Continued)

OTHER PUBLICATIONS

International Search Report for PCT/US2008/059748 dated Aug. 15, 2008.

*Primary Examiner* — Robert J Scruggs
(74) *Attorney, Agent, or Firm* — Kirton McConkie; Brian Tucker

(57) ABSTRACT

A toothbrush for infants includes an elongate grasping region with a head at one end and a bottom at the other end. The head of the toothbrush includes a plurality of bristles, which may be formed from a soft, resiliently compressible material. The elongate grasping region may have dimensions that enable it to be held by an infant's hand while preventing its insertion and, thus, over-insertion of the toothbrush, into the infant's mouth. Various other features may be included to guide an infant's hand to an appropriate location on the toothbrush, as well as to enable an infant to grip the grasping region, particularly when moisture is present on the surface of the grasping region.

19 Claims, 3 Drawing Sheets

(56) References Cited

U.S. PATENT DOCUMENTS

| | | | | |
|---|---|---|---|---|
| D358,938 | S * | 6/1995 | Schneider | D4/104 |
| 5,623,739 | A * | 4/1997 | Thompson | 15/167.1 |
| 5,813,079 | A * | 9/1998 | Halm | A46B 5/0025 15/167.1 |
| 6,199,242 | B1 * | 3/2001 | Masterman et al. | 15/167.1 |
| 6,546,583 | B1 * | 4/2003 | Rohrig | A46B 5/02 15/110 |
| 6,601,272 | B2 * | 8/2003 | Stvartak | A46B 5/02 132/200 |
| D514,321 | S * | 2/2006 | Moskovich | D4/104 |
| 2003/0014825 | A1 * | 1/2003 | Rohrig | A46B 5/02 15/167.1 |
| 2003/0046780 | A1 * | 3/2003 | Davis | A46B 5/0095 15/167.1 |
| 2003/0172483 | A1 * | 9/2003 | Davis | A46B 5/0095 15/167.1 |
| 2004/0163191 | A1 * | 8/2004 | Cuffaro | A61C 17/22 15/28 |
| 2004/0187889 | A1 * | 9/2004 | Kemp | A46B 5/0095 132/311 |
| 2004/0200748 | A1 | 10/2004 | Kalssen et al. | |
| 2005/0271997 | A1 * | 12/2005 | Mikami et al. | 433/29 |
| 2006/0037160 | A1 * | 2/2006 | Kayser | A46B 5/0079 15/167.1 |
| 2007/0006411 | A1 * | 1/2007 | Foster | A46D 1/0238 15/207.2 |
| 2007/0163064 | A1 * | 7/2007 | Wong | A46B 5/026 15/143.1 |
| 2008/0168613 | A1 * | 7/2008 | Kraemer | 15/167.1 |
| 2009/0178219 | A1 * | 7/2009 | Hohlbein | A46B 5/007 15/167.1 |

* cited by examiner

INFANT TOOTHBRUSH

CROSS-REFERENCE TO RELATED APPLICATION

This application claims priority to International Application No. PCT/US08/059748 filed Apr. 9, 2008, published in English as PCT International Publication No. WO/2009/002583 A1 on Dec. 31, 2008, which claims the benefit of the filing date of U.S. Provisional Application No. 60/949,329, filed Jun. 26, 2007, for "INFANT TOOTHBRUSH," the disclosures of which are hereby incorporated herein, in their entirety, by this reference.

TECHNICAL FIELD

The present invention relates generally to teething apparatus and toothbrushes for infants and, more specifically, to teething apparatus and toothbrushes that are configured to maximize an infant's oral comfort while promote healthy habits and minimizing risk of injury.

BACKGROUND

Infant toothbrushes are often configured similarly to conventional teething rings. More specifically, existing infant toothbrushes, such as that described in U.S. Pat. No. 5,048,143, include a large, ring-shaped handle with bristles protruding therefrom. As a consequence of such a configuration, the bristles cannot be inserted into the mouth of an infant in a manner similar to the use of a conventional toothbrush. Moreover, since the handle of such a toothbrush is configured like a teething ring, it, and any germs on its surface, may be easily inserted into the infant's mouth.

The inventor is not aware of an infant toothbrush that is configured for use like a conventional toothbrush, with features that optimize safety and comfort for infant use.

DISCLOSURE OF THE INVENTION

The present invention includes an apparatus that includes soft bristles for brushing an infant's gums and/or teeth. Accordingly, an apparatus that incorporates teachings of the present invention is referred to herein as a "toothbrush." The toothbrush may be configured and, optionally, include features that also facilitate its use as a teething apparatus, or toy.

In one embodiment, such a toothbrush may be an elongate element that includes an elongate grasping region with a head at one end and a bottom at the other end. The head of the toothbrush includes a plurality of bristles, which may be formed from a soft, resiliently compressible material. The elongate grasping region may have dimensions that enable it to be held by an infant's hand while preventing its insertion and, thus, over-insertion of the toothbrush, into the infant's mouth. Various other features may be included to guide an infant's hand to an appropriate location on the toothbrush, as well as to enable an infant to grip the grasping region, particularly when moisture is present on the surface of the grasping region.

A toothbrush that incorporates teachings of the present invention may be somewhat curved, such as with a generally crescent shape. The curvature of the toothbrush, as well as other features thereof (e.g., the size and/or shape of a head of the toothbrush, a size and/or shape of a bottom of the toothbrush, etc.), may be configured to facilitate introduction of the head and/or bottom of the toothbrush into otherwise difficult-to-reach areas of an infant's mouth (e.g., posterior regions, etc.).

According to another aspect, the present invention includes methods for teaching or training children proper oral hygiene techniques. Such methods may include use of a toothbrush with bristles that will not damage or irritate an infant's sensitive gums with prolonged use, use of a toothbrush having guiding features that facilitate placement of an infant's hand to an appropriate location on the toothbrush, and use of a toothbrush with features that enable an infant to maintain a firm grasp even in the presence of moisture. In use, a toothbrush is placed in an infant's hand, the head of the toothbrush is introduced into the infant's mouth, and the toothbrush is move moved in a rubbing or brushing motion.

Other features and advantages of the present invention will become apparent to those of ordinary skill in the art through consideration of the ensuing description, the accompanying drawings, and the appended claims.

DESCRIPTION OF THE DRAWINGS

In the drawings, which depict various features of an embodiment of and infant toothbrush of the present invention.

MODE(S) FOR CARRYING OUT THE INVENTION

Figure 1:
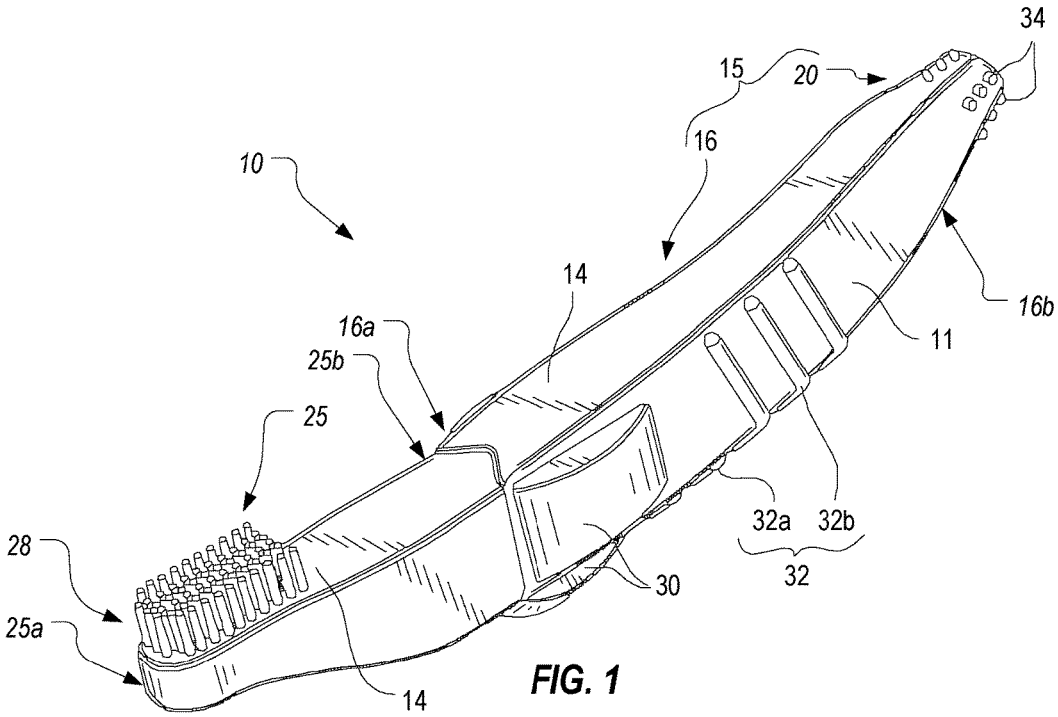
FIG. 1 is a perspective view of the infant toothbrush.

An embodiment of a toothbrush 10 that incorporates teachings of the present invention is shown in FIGS. 1 through 7. Toothbrush 10 includes an elongate handle 15 with a central, grasping region 16 and a bottom 20 that extends proximally from a proximal end 16*b* of grasping region 16. A head 25 extends distally from a distal end 16*a* of grasping region 16. Head 25 includes a proximal end 25*b* that couples to distal end 16*a* of grasping region 16 and a distal end 25*a*.

Figure 2:
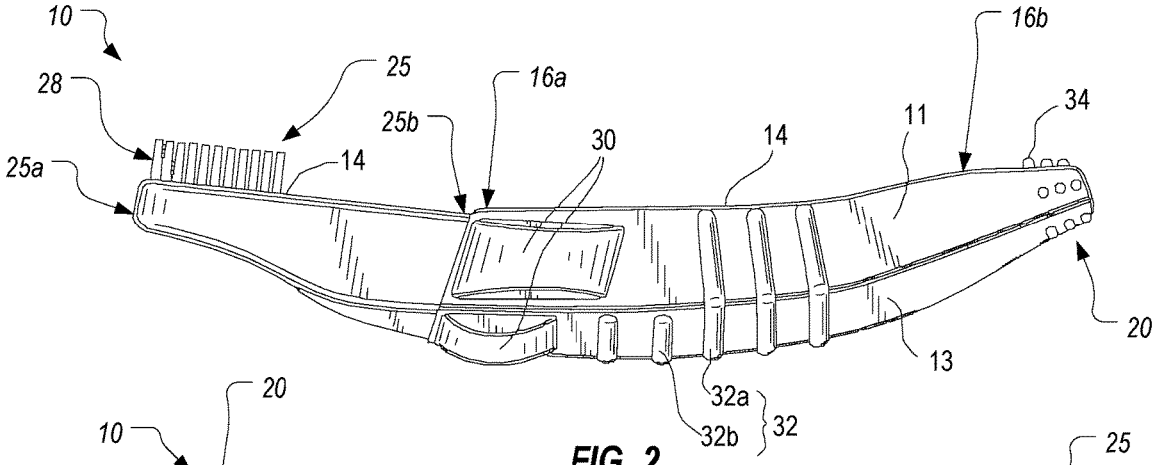
FIG. 2 shows one side of the infant toothbrush.
Figure 3:
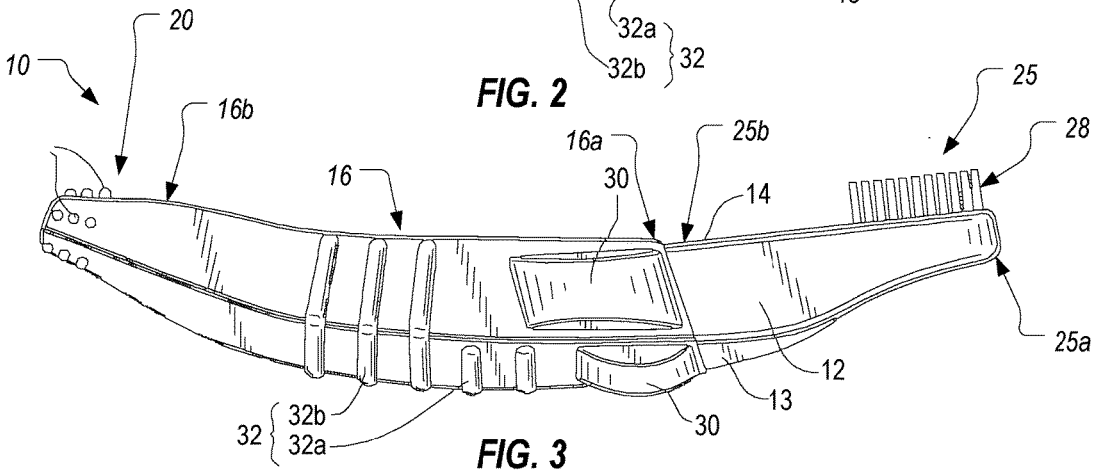
FIG. 3 depicts the other side of the infant toothbrush.

As depicted, toothbrush 10 may have a somewhat curved shape, such as a crescent shape or the general appearance of a banana, as depicted in FIGS. 1 through 7. More particularly, and as best seen in FIGS. 2 and 3, face 14 of toothbrush 10 forms a concave surface between distal end 25*a* of head 25 and proximal end 16*b* of grasping region 16. Such a shape facilitates insertion of toothbrush 10 into areas of an infant's mouth into which other infant toothbrushes or teething apparatus may not be easily introduced, including posterior regions. As a result, the overall shape of toothbrush 10 may be configured to facilitate massaging of gums, reduction in pain, and/or reduction of cavity-causing bacteria from otherwise difficult to reach regions of an infant's mouth.

Figure 4:
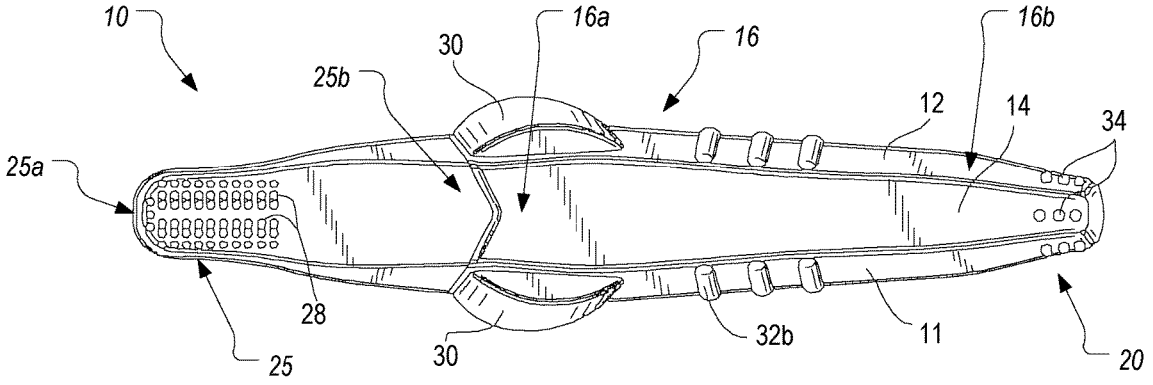
FIG. 4 is a top view of the infant toothbrush.
Figure 5:
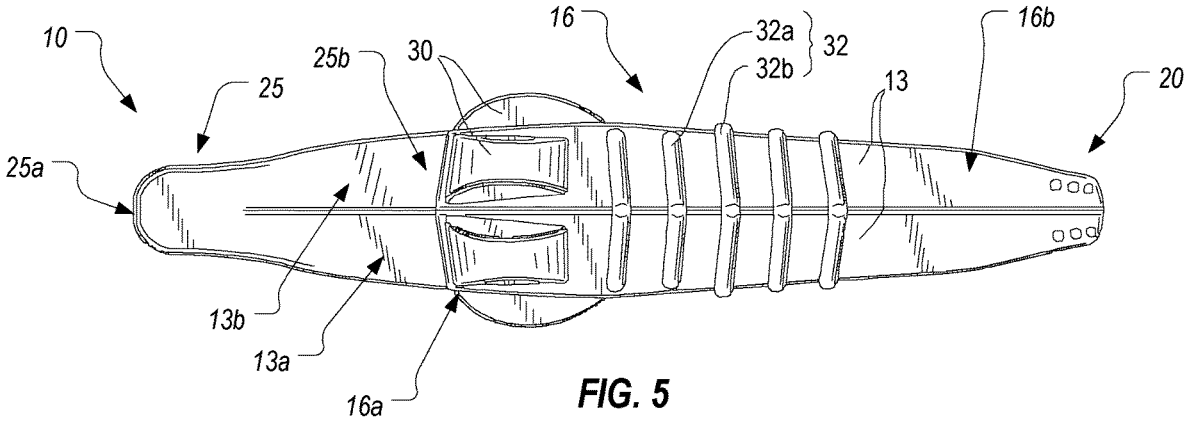
FIG. 5 is a bottom view of the infant toothbrush.
Figure 6:
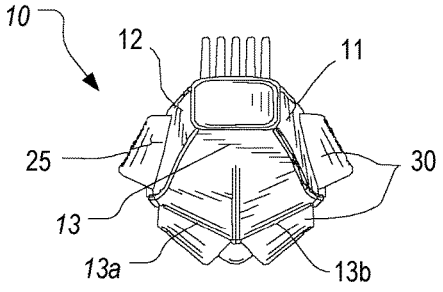
FIG. 6 illustrates the infant toothbrush from an end of its head.
Figure 7:
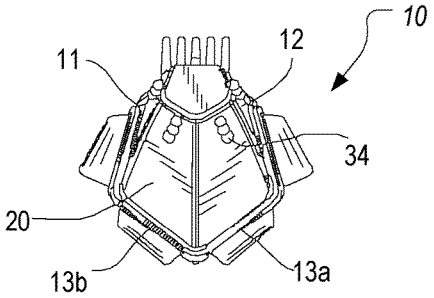
FIG. 7 depicts the infant toothbrush from its bottom end.

Toothbrush 10 includes a back 13 opposite face 14 and opposing sides 11 and 12 that extend between face 14 and back 13. As best seen in FIG. 5, back 13 may be formed by two angled surfaces 13*a* and 13*b* along gripping region 16 and proximal end 25*b* of head 25 and then transition to a single, substantially flat surface towards distal end 25*a* of head 25. With reference to FIG. 4, the width of face 14 tapers towards distal end 25*a* of head 25. The width of face 14 also tapers towards proximal end 16*b* of grasping region 16. With reference to FIGS. 2 and 3, the width of sides 11 and 12 tapers towards distal end 25*a* of head 25. The width of sides 11 and 12 also tapers towards proximal end 16*b* of grasping region 16. Of course, toothbrushes of other shapes or configurations are also within the scope of the present invention.

The cross-sectional dimensions of grasping region 16, taken transverse to its length (and, thus, to the length of handle 15), are, when considered in connection with the length of toothbrush 10, configured to minimize any choking hazards presented by toothbrush 10. Additionally, the cross-sectional dimensions of grasping region 16 enable infants to firmly grasp and manipulate (e.g., use) toothbrush 10.

As FIGS. 1 through 3 illustrate, the portion of face 14 along head 25 is substantially flat. A group of bristles 28 protrudes from face 14 at distal end 25*a* of head 25. Bristles 28 may be arranged in any suitable manner known in the art for brushing teeth, with the substantially parallel bristles that are shown merely comprising a non-limiting example of a bristle arrangement. The length of head 25, as well as its cross-sectional dimensions, taken transverse to its length, may facilitate insertion of head 25 and, thus, of bristles 28 into an infant's mouth. Of course, these dimensions may also be configured to prevent gagging by the infant.

Gagging may be further prevented by the presence of one or more stoppers 30 between head 25 and handle 15 of toothbrush 10. In the illustrated example, toothbrush 10 includes three stoppers 30, two of which are positioned on opposite sides 11 and 12 of toothbrush 10, with a third protruding from a back 13 of toothbrush 10. Each of stoppers 30 is positioned at distal end 16*a* of grasping region 16. Stoppers 30 may be configured to provide a region of enlarged cross-sectional dimensions along the length of toothbrush 10 to limit the distance that toothbrush 10 may be inserted into an infant's mouth. In other words, each stopper 30 comprises a protruding portion of the corresponding side 11 or 12 or back 13. Stoppers 30 of the illustrated embodiment enhance the overall appearance of toothbrush 10, having the look of portions of a banana peel that have been pulled away from an end of the banana.

Stoppers 30 may also have dimensions and a shape that guide an infant's hand to an appropriate location along the length of grasping region 16 of handle 15, which may be useful in training the infant to hold and manipulate a toothbrush. Due to their positioning adjacent to grasping region 16, stoppers 30 may prevent slippage of the infant's hands as he or she is using toothbrush 10.

An infant's gripping of toothbrush 10 may also, or alternatively, be facilitated by grip-enhancing features associated with grasping region 16. As a non-limiting example of grip-enhancing features, grasping region 16 may include raised ridges, or grips 32, that enable an infant to firmly grasp toothbrush 10 regardless of the material from which grasping region 16 is formed, or the presence of moisture (e.g., water, saliva, etc.) on grasping region 16. As shown, grips 32 are elongate elements that are oriented transverse to the length of and protrude slightly from grasping region 16, with some grips 32*a* extending across only the width of back 13 of toothbrush 10 and other grips 32*b* extending across the width of back 13 and down sides 11 and 12 of toothbrush 10. Of course, a wide variety of other grip-enhancing features and arrangements of such features are also within the scope of the present invention.

Bottom 20 of handle 15 may have smaller cross-sectional dimensions, taken transverse to the length of handle 15, than the corresponding cross-sectional dimensions of proximal end 16*b* of grasping region 16, similar to the relative dimensions of head 25 and distal end 16*a* of grasping region 16. The dimensions of bottom 20 may facilitate its insertion into a teething infant's mouth.

Teething features, such as the depicted nubs 34 or the like (e.g. ridges, indentations, etc.), may be present on bottom 20. In the pictured embodiment, nubs 34 are arranged in rows of three that extend along the length of bottom 20, with one row on each of sides 11 and 12, back 13, and face 14 of toothbrush 10.

The shape of toothbrush 10, including the central position of grasping region 16 between regions (i.e., bottom 20 and head 25) that are configured to be inserted into an infant's mouth, as well as the larger size of grasping region 16 and the location of stoppers 30, may prevent the surfaces of toothbrush 10 that are most likely to be handled by the infant from being introduced into the infant's mouth. Thus, toothbrush 10 may have a shape that reduces the likelihood that germs will be introduced into the infant's mouth.

Toothbrush 10 and, optionally, features thereof (e.g., bristles 28, stoppers 30, grips 32, and nubs 34) may be formed from a soft, compressible. resilient material, which minimizes irritation to the infant's gums and teeth, and is less susceptible to causing damage within an infant's mouth in the event that toothbrush 10 is forcefully inserted into the infant's mouth (e.g., as the result of a fall, over-exuberant movement by the infant, etc.). For example, and not by way of limitation, hypoallergenic silicone may be used to form toothbrush 10. The material from which toothbrush 10 is formed may have a color that corresponds to its configuration (e.g., one or more shades of yellow when toothbrush 10 is configured as a banana), that may attract an infant's interest, or for any other purpose.

Additionally, the material of toothbrush 10 may include fragrance or flavoring (e.g., a banana scent or flavor, etc.). In the depicted embodiment, all of the external features of toothbrush 10 are formed from the same material, with separately molded features (e.g., head 25 and handle 15) having been assembled and glued or cemented to one another (e.g., with a room temperature vulcanizing (RTV) silicone, etc.). Alternatively, some features of toothbrush 10 may be formed from different materials. For example, head 25 may include bristles 28 that are formed from conventional materials (e.g., synthetic fibers, such as the polyamide fibers marketed by DuPont de Nemours & Co. of Wilmington, Del., under the trade mark NYLON®) that protrude from a suitable carrier (e.g., a plastic base).

Figure 8:
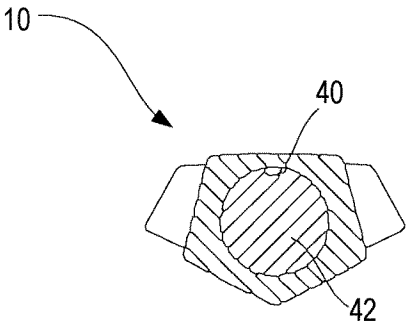
FIG. 8 shows a cross-section taken through a central location of the toothbrush, transverse to its length.
Figure 9:
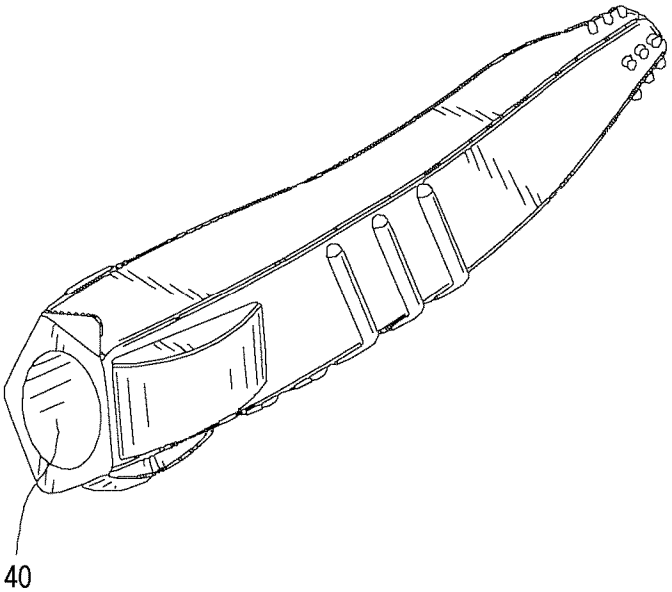
FIG. 9 is an exploded perspective view of the toothbrush.
Figure 9:
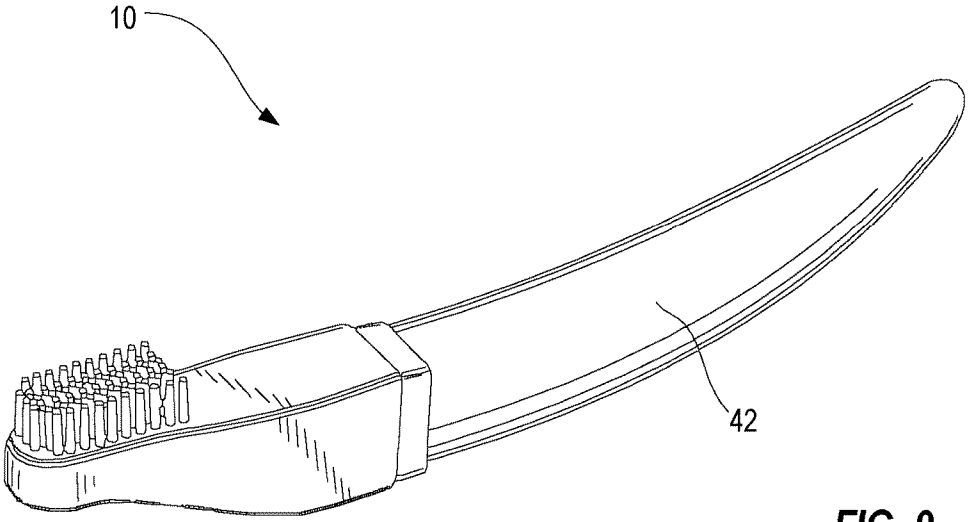

Referring now to FIGS. 8 and 9, toothbrush 10 may include an interior cavity 40 within which an insert 42 is positioned (e.g., during assembly of separately molded parts). Insert 42 may impart toothbrush 10 with more rigidity and support than that provided by the material or materials used to form the remainder of toothbrush 10. In the example where silicone is used to form the majority of toothbrush 10, a harder, more rigid polymer with some flexibility may be used for insert 42 (e.g., a suitable thermoplastic elastomer (TPE), etc.).

Toothbrush 10 may be used in any of a variety of ways. Toothbrush 10, as well as any bristles 28 and nubs 34 thereof, are particularly useful for massaging and easing pain in an infant's gums. Toothbrush 10 may be cooled or coated with an anesthetic agent prior to use to provide further pain relief. Due to its suitability for use with infants, for example, because of its dimensions and the materials from which it is formed, toothbrush 10 may be more suitable for use in training infants to brush their teeth (e.g., less irritating to an infant's gums and teeth) than conventionally configured toothbrushes. By using toothbrush 10, an infant may be exposed to and, thus, learn oral brushing motions and techniques and, thus, oral hygiene, at an early age.

Although the foregoing description includes many specifics, these should not be construed as limiting the scope of the present invention but, merely, as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed:

1. A toothbrush comprising:

a handle having a grasping region, the grasping region having a proximal end and a distal end;

a head having a proximal end and a distal end, the distal end of the head forming the distal end of the toothbrush, the proximal end of the head being coupled to the distal end of the grasping region; and bristles that emanate from the head, wherein the handle, head, and bristles are all formed of silicone;

wherein the handle and the head have a face, a back, and opposing sides that extend between the face and the back, each of the face, the back and the opposing sides forming a different surface that is oriented at a different angle;

wherein the handle and the head have a crescent shape such that the face is concave between the proximal end of the grasping region and the distal end of the head and the back is convex from the proximal end of the grasping region to the distal end of the head, the bristles emanating from the face.

2. The toothbrush of claim 1, wherein a width of the face tapers towards the distal end of the head.

3. The toothbrush of claim 2, wherein the width of the face also tapers towards the proximal end of the grasping region.

4. The toothbrush of claim 1, wherein a width of each opposing side tapers towards the distal end of the head and also tapers towards the proximal end of the grasping region.

5. The toothbrush of claim 1, wherein the handle includes a bottom that extends proximally from the proximal end of the grasping region, the bottom having smaller cross-sectional dimensions, taken transverse to a length of the handle, than corresponding cross-sectional dimensions of the proximal end of the grasping region.

6. The toothbrush of claim 5, wherein the bottom includes one or more nubs, each of the one or more nubs protruding from either the face, the back, or one of the opposing sides.

7. The toothbrush of claim 6, wherein the one or more nubs comprise at least one nub that protrudes from the face, at least one nub that protrudes from the back, at least one nub that protrudes from one of the opposing sides, and at least one nub that protrudes from the other opposing side.

8. The toothbrush of claim 1, wherein each of the opposing sides includes a stopper that is positioned towards the distal end of the grasping region, each stopper comprising a protruding portion of the corresponding opposing side that extends outwardly beyond an outer edge of the face.

9. The toothbrush of claim 8, wherein the back also includes a stopper that is positioned towards the distal end of the grasping region, the stopper comprising a protruding portion of the back.

10. The toothbrush of claim 1, wherein the handle includes one or more grips that each comprises a protrusion that extends along one of the opposing sides, around the back, and along the other opposing side in a direction that is transverse to a length of the handle.

11. The toothbrush of claim 10, wherein the handle further includes one or more additional grips that each comprises a protrusion that extends only along the back in a direction that is transverse to the length of the handle.

12. The toothbrush of claim 11, wherein the one or more additional grips are positioned adjacent to and parallel with the one or more grips.

13. The toothbrush of claim 12, wherein the one or more additional grips are positioned towards the distal end of the grasping region from the one or more grips.

14. The toothbrush of claim 1, wherein the back is substantially planar along the distal end of the head but is formed of two angled surfaces along the proximal end of the head and along the grasping region.

15. The toothbrush of claim 1, wherein a width of the back along the grasping region is greater than a width of the face along the grasping region.

16. The toothbrush of claim 1, wherein the handle has a first color and the head has a second color.

17. The toothbrush of claim 1, wherein the silicone includes one or both of a scent and a flavor.

18. A toothbrush comprising:

a handle having a grasping region, the grasping region having a proximal end and a distal end;

a head having a proximal end and a distal end, the distal end of the head forming the distal end of the toothbrush, the proximal end of the head being coupled to the distal end of the grasping region; and bristles that emanate from the head, wherein the handle, head, and bristles are all formed of silicone;

wherein the handle and the head have a face, a back, and opposing sides that extend between the face and the back, each of the face, the back and the opposing sides forming a different surface that is oriented at a different angle;

wherein the handle and the head have a crescent shape such that the face is concave between the proximal end of the grasping region and the distal end of the head and the back is convex from the proximal end of the grasping region to the distal end of the head, the bristles emanating from the face;

wherein a width of the face tapers towards the distal end of the head and also tapers towards the proximal end of the grasping region;

wherein a width of each opposing side tapers towards the distal end of the head and also tapers towards the proximal end of the grasping region.

19. The toothbrush of claim 18, wherein each of the opposing sides includes a stopper that is positioned towards the distal end of the grasping region, each stopper comprising a protrusion from the corresponding opposing side that extends outwardly beyond an outer edge of the face.

* * * * *